US005310993A

United States Patent [19]

McWilliams et al.

[11] Patent Number: 5,310,993

[45] Date of Patent: May 10, 1994

[54] DEVICE FOR CONTROLLING OR LIMITING TEMPERATURE IN AN ELECTRIC COOKING APPLIANCE

[75] Inventors: Kevin R. McWilliams, Stratford-upon-Avon; Stuart Lamb, Redditch, both of United Kingdom

[73] Assignee: Ceramaspeed Limited, United Kingdom

[21] Appl. No.: 637

[22] Filed: Jan. 5, 1993

[30] Foreign Application Priority Data

Jan. 23, 1992 [GB] United Kingdom ..... 9201443

[51] Int. Cl.[5] ..... H01H 37/48

[52] U.S. Cl. ..... 219/449; 219/464; 337/394

[58] Field of Search ..... 219/449, 448, 464, 451, 219/452; 374/196, 205, 187, 208; 337/393, 394, 395, 382

[56] References Cited

U.S. PATENT DOCUMENTS

| | | | |
|---|---|---|---|
| 2,210,526 | 8/1940 | Burling | 337/395 |
| 2,705,746 | 4/1955 | Strange | 337/394 |
| 2,809,523 | 10/1957 | Burling | 337/395 |
| 4,008,454 | 2/1977 | Bowling | 337/394 |
| 4,267,815 | 5/1981 | Goessler | 126/39 |
| 4,555,688 | 11/1985 | Bayer | 337/394 |
| 4,577,176 | 3/1986 | Bayer | 219/449 |
| 4,633,238 | 12/1986 | Goessler et al. | 337/394 |
| 4,901,049 | 2/1990 | Kicherer et al. | 337/394 |

FOREIGN PATENT DOCUMENTS

| | | | |
|---|---|---|---|
| 0279368 | 8/1988 | European Pat. Off. . | |
| 959140 | 2/1957 | Fed. Rep. of Germany | 374/205 |
| 2435796 | 4/1980 | France . | |
| 2133879 | 8/1984 | United Kingdom . | |

*Primary Examiner*—Bruce A. Reynolds
*Assistant Examiner*—John A. Jeffery
*Attorney, Agent, or Firm*—Ira S. Dorman

[57] ABSTRACT

A device for controlling or limiting temperature in an electric cooking appliance includes a switch and a temperature sensor operatively coupled to the switch. The temperature sensor takes the form of a rod arranged substantially coaxially within a tube. The rod is made of a material having a first coefficient of thermal expansion and the tube is made of at least two tube portions, one of the tube portions being made from a material having a second coefficient of thermal expansion lower than the first coefficient of thermal expansion and another of the tube portions being made from a ceramic material having a third coefficient of thermal expansion intermediate the first and second coefficients of thermal expansion. The temperature controlling or limiting device may be incorporated into a radiant electric heater incorporating at least first and second heating elements defining separate heating areas for the cooking appliance.

11 Claims, 2 Drawing Sheets

DEVICE FOR CONTROLLING OR LIMITING TEMPERATURE IN AN ELECTRIC COOKING APPLIANCE

The present invention relates to a device for controlling or limiting temperature in an electric cooking appliance and may be used, for example, in conjunction with an electric radiant heater having at least two heating elements to control or limit the temperature of a cooking surface of glass ceramic or the like in an electric cooking appliance.

BACKGROUND TO THE INVENTION

Such temperature control devices are known in conjunction with radiant heaters installed in glass ceramic top cookers. The devices typically incorporate a rod-like temperature sensor that operates on the basis of a difference in thermal expansion coefficients between an expansion member of the sensor and a reference member of the sensor. The difference in thermal expansion gives rise to differential movement which, in turn, is employed to operate one or more switches which are used, for example, to limit the temperature of the glass ceramic cooking surface and/or to indicate that the surface of the glass ceramic may be too hot to be touched. The temperature sensor generally comprises a rod of high expansion material located coaxially within a tube of low expansion material such as quartz (more correctly known as fused silica). Alternatively, the temperature sensor may comprise a rod of low expansion material located coaxially within a tube of high expansion material.

Where at least two heating elements are incorporated in the radiant heater it is known, for example from United Kingdom Patent Specification No. 2 069 300, to isolate the temperature sensor from the heating effect of all except one of the heating elements. This can be achieved by enclosing part of the temperature sensor in a thermal insulation material or in a thermally conductive material which transmits the heat away to a heat sink, or by limiting the effective length of the temperature sensor to that part which extends over the relevant heating element. This latter means for isolating the temperature sensor can be put into effect by connecting part of the temperature sensor across the heating elements from which it is to be isolated in a manner which precludes those heating elements from influencing the response given by the sensor.

United Kingdom Patent Specification No. 2 080 660 also discloses a radiant heater having at least two heating elements wherein the temperature sensor is isolated from the heating effect of all but one of the heating elements. According to United Kingdom Patent Specification No. 2 080 660 this is achieved by extending the heating effect of the one heating element so as to influence substantially the entire effective length of the temperature sensor. United Kingdom Patent Specification No. 2 133 879 discloses means for isolating part of the temperature sensor from heat emitted by the heating elements of a radiant heater. According to United Kingdom Patent Specification No. 2 133 879 the temperature sensor comprises a rod of high thermal expansion material arranged coaxially within a tube which is assembled from at least two tubular sections. The tubular sections have different thermal expansions such that the overall thermal expansion of the whole tube is less than the thermal expansion of the rod. In practice, the rod is made of an iron-chromium alloy, one of the tubular sections is made of quartz glass or ceramic material and the other tubular section is made of the same material as the rod. Whilst such a temperature sensor can undoubtedly be isolated from all but the chosen heating element, the drawback is that the tubular section or sections where the temperature sensor is isolated are made of a relatively expensive material which requires to be machined to the required tubular shape. Additionally, because one or more of the tubular sections is or are made of metal and reduces the electrical clearance distance between the electrically live heating coil and the underside of the glass ceramic cooking surface, it is necessary electrically to insulate the metal section. This is achieved by surrounding the metal section with a tube of electrically insulating material, such as quartz glass or other ceramic material, which adds to the cost of the temperature control device. The result is that the temperature control device is not economic to manufacture.

European Patent Specification No. 0 141 923 also discloses means for isolating part of the temperature sensor. According to European Patent Specification No. 0 141 923 the temperature sensor comprises a tube of high thermal expansion material such as high-quality steel having arranged therein a rod made of at least two sections. One of the rod sections is made of a ceramic material, but the remaining section or sections are made of a material having a coefficient of thermal expansion at least as high, and preferably higher than that of the tube, thus providing a form of over-compensation in the response of the sensor to variations in temperature. In order to provide electrical isolation for the metal tube it is necessary to provide a further tube of quartz glass around the entire length of the metal tube. Such a temperature sensor has the disadvantage that the further tube acts as a heat sink and causes the temperature response of the sensor to lag behind the actual temperature. Moreover, the further tube constitutes an additional component which adds to the cost of the temperature control device and renders it uneconomic to manufacture.

Despite these drawbacks of known temperature control devices which are intended to provide temperature compensation for the sensor where it passes over heating elements from which it is required to be thermally isolated, such devices avoid the need for a block of thermal insulation material and represent an aesthetically appealing solution to the problem of achieving such isolation.

OBJECT OF THE INVENTION

It is an object of the present invention to provide a device for controlling or limiting temperature in an electric cooking appliance which is economic to manufacture and which provides an acceptable level of thermal isolation where required.

SUMMARY OF THE INVENTION

According to a first aspect of the present invention there is provided a device for controlling or limiting temperature in an electric cooking appliance, the device comprising switch means and a temperature sensor operatively coupled to the switch means, the temperature sensor comprising a rod arranged substantially coaxially within a tube, the rod being made of a material having a first coefficient of thermal expansion and the tube comprising at least two tube portions, one of the tube portions being made from a material having a second coefficient of thermal expansion lower than the first coefficient of thermal expansion and another of the tube portions being made from a ceramic material having a third coefficient of thermal expansion intermediate the first and second coefficients of thermal expansion.

The ceramic material may comprise an electrically insulating material.

The third coefficient of thermal expansion may be from 39 to 78 per cent, preferably 46 to 66 per cent, of the first coefficient of thermal expansion.

The tube may comprise two tube portions.

The ceramic material may have a relatively high emissivity. For example the ceramic material may incorporate, or be coated with, a material having high emissivity.

According to a second aspect of the present invention there is provided a radiant electric heater for a cooking appliance comprising at least first and second heating elements defining separate heating areas for the cooking appliance, and a device for controlling or limiting temperature according to the first aspect of the present invention, the tube portions of the device being dimensioned and positioned such that each tube portion of material having the second coefficient of thermal expansion is exposed to heat emitted substantially the first heating element and each tube portion of ceramic material having the third coefficient of thermal expansion is exposed to heat emitted substantially from the second heating element.

The heating elements may be separated by one or more walls of thermal insulation material. Each junction between a tube portion of material having the second coefficient of thermal expansion and ceramic material having the third coefficient of thermal expansion may be located within a separating wall.

For a better understanding of the present invention and to show more clearly how it may be carried into effect reference will now be made, by way of example, to the accompanying drawings in which:

DESCRIPTION OF PREFERRED EMBODIMENTS

Figure 1:
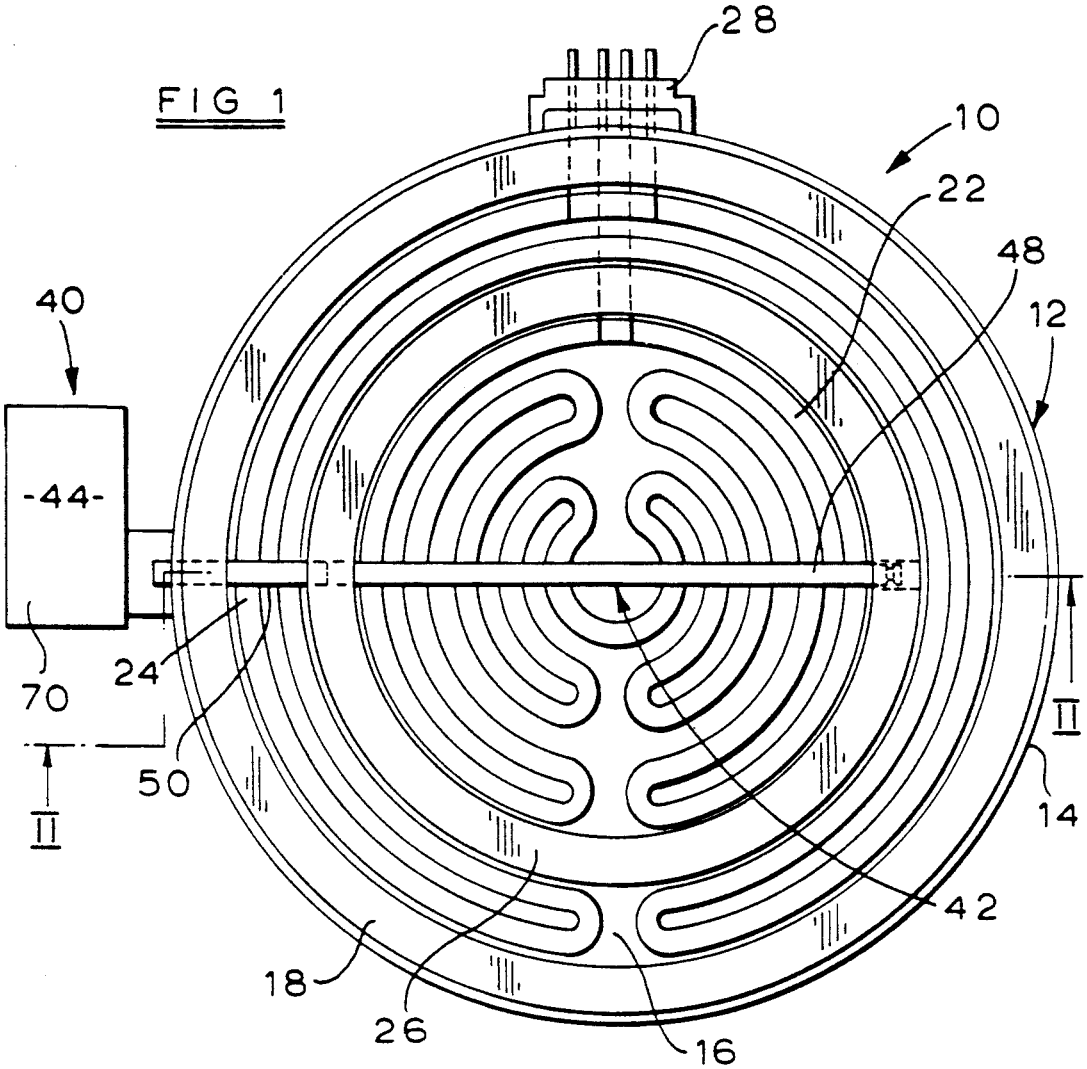
FIG. 1 is a plan view of a radiant heater for use in an electric cooking appliance, the heater incorporating a temperature control device according to the present invention.
Figure 2:
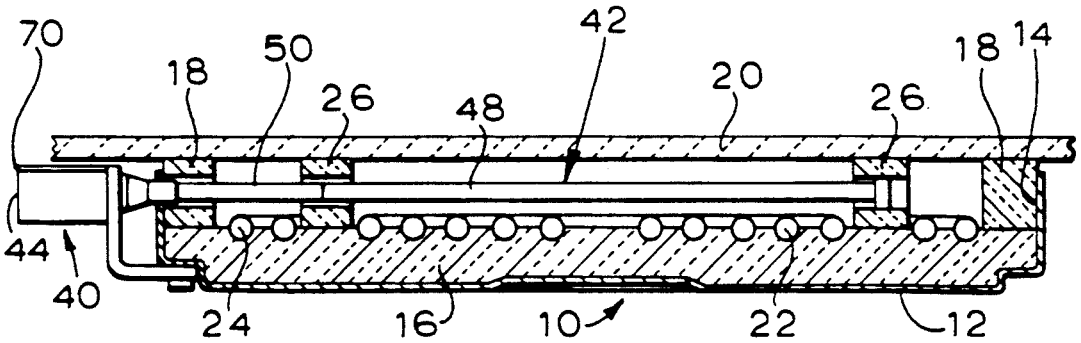
FIG. 2 is a sectional view along the line II—II in FIG. 1, but also showing a glass ceramic plate of the electric cooking appliance.

FIGS. 1 and 2 show a radiant electric heater 10 which has a container in the form of a metal dish 12 with an upstanding rim 14 and containing a layer of electrical and thermal insulating material 16. This material is for example a microporous insulation which is compressed into the dish 12, and which comprises a highly-dispersed silica powder, such as silica aerogel or pyrogenic (fumed) silica, mixed with a ceramic fiber reinforcement, titanium dioxide pacifier and a small quantity of alumina powder to resist shrinkage. A ring-shaped wall 18 of ceramic fiber extends around the inside of the rim 14 of the dish 12, on top of the layer 16 and protruding slightly above the edge of the rim 14. When installed in a glass ceramic top cooker the wall 18 is pressed against the underside of a glass ceramic cooking surface 20, shown in FIG. 2, the heater being held in position by a spring or other mounting device (not shown). Prior to installation the wall 18 may be retained in position by staples (not shown) extending into the layer 16.

The layer 16 supports two coiled bare resistance-wire heating elements 22 and 24 arranged concentrically with heating element 24 positioned within and adjacent the wall 18 and heating element 22 positioned within the heating element 24. Heating elements 22 and 24 are separated by a ring-shaped wall 26 of ceramic fiber material positioned on top of the layer 16 and retained in position by staples or pins (not shown). The height of wall 26 is such that it is not higher, and may be about 1 mm lower, than the wall 18 in order that contact between the wall 18 and the underside of the glass ceramic cooking surface should be maintained and to ensure that no heat is lost from the heater through gaps between the wall 18 and the underside of the glass ceramic cooking surface 20.

The coiled heating elements 22 and 24 are secured to the layer 16 by, for example, staples held by friction in the insulating material of the layer 16, or by gluing to the layer 16 or to stakes inserted therein. The ends of the heating elements 22 and 24 are coupled to respective conductors in an electrical connector block 28 mounted at the edge of the dish 12.

As is customary with radiant heaters for glass ceramic top cookers, a temperature control device 40 is provided with an elongate temperature sensor 42 extending across the heater 10 between the heating elements 22 and 24 and the underside of the glass ceramic cooking surface 20 from one edge of the dish, through the wall 18, across the heating element 24, through the wall 26, across the heating element 22 and into the wall 26 again. A snap-action switch 44 controlled by the temperature sensor 42 is provided for connection in series with the heating elements 22 and 24, to prevent heating of the cooktop 20 above its maximum safe temperature.

Figure 3:
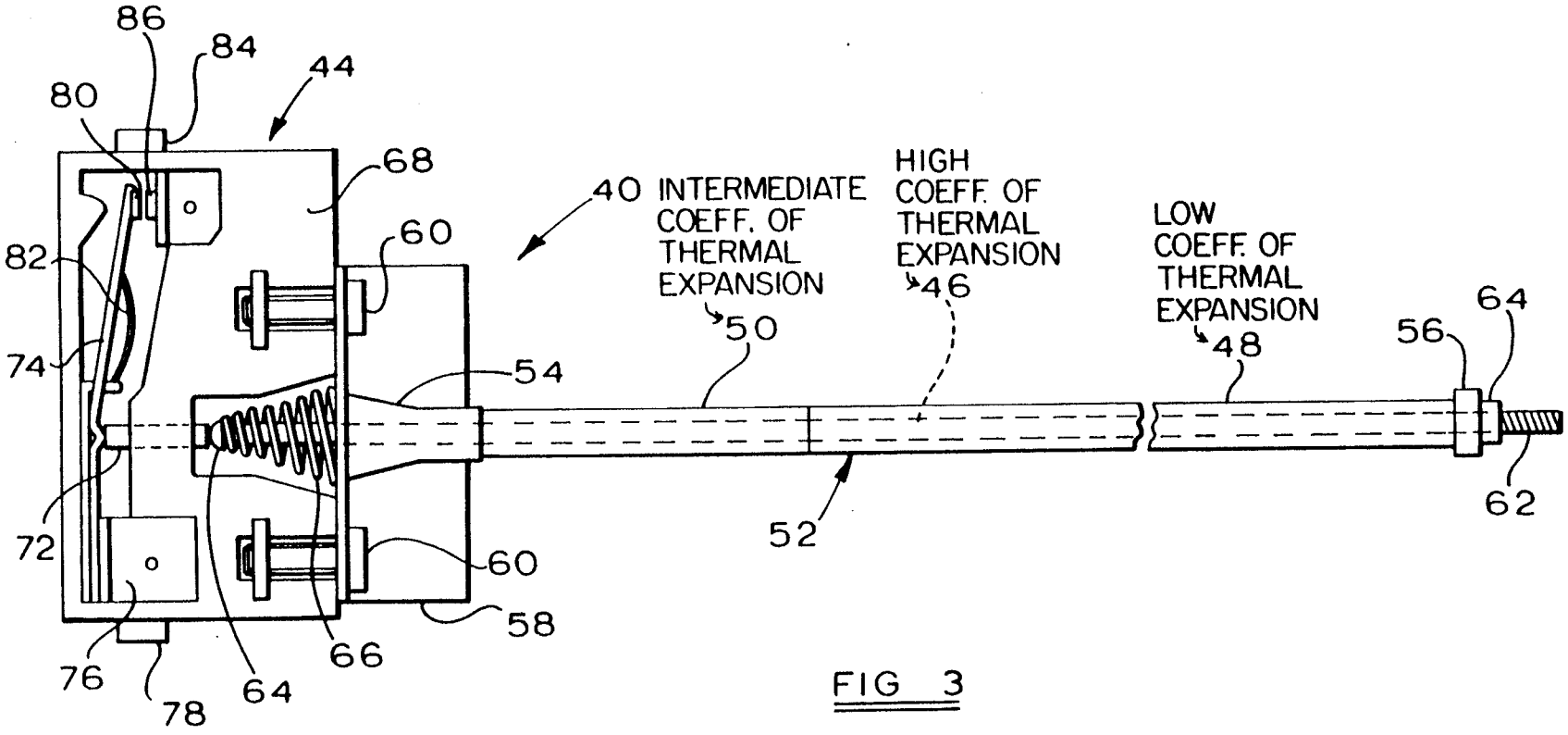
FIG. 3 is a plan view of the temperature control device on a larger scale and showing the manner of operation of the device.

The temperature control device 40 is shown in more detail in FIG. 3 where it can be seen that the temperature sensor comprises a rod 46 of material having a high coefficient of thermal expansion, for example a nickel-chromium or an iron-chromium alloy having a coefficient of thermal expansion of about 16 to $18\times10^{-6}$, the rod being arranged coaxially within two axially adjacent tube portions 48, 50 of a tube 52. Tube portion 48, which extends over the heating element 22, is made of a material having a low coefficient of thermal expansion, such as fused silica (otherwise sometimes known in the art as quartz glass) having a coefficient of thermal expansion of about $0.5\times10^{-6}$, while the tube portion 50, which extends over the heating element 24, is made of an electrically insulating ceramic material having a coefficient of thermal expansion intermediate that of the tube portion 48 and the rod 46.

The tube 52 is provided with end caps 54 and 56, end cap 54 being supported on a mounting plate 58 for the temperature control device. The mounting plate 58 is secured to the snap-action switch 44 by means of screws 60. The rod 46 passes through apertures in the end cap 54, the mounting plate 58 and the end cap 56 and at the end of the rod adjacent to the end cap 56 the rod is formed with a threaded portion 62. An adjusting nut 64 is threaded onto the threaded portion 62 and bears against the end cap 56. The other end of the rod 46 is formed with a domed head 64 and a compression spring 66 is positioned between the domed head 64 and a housing 68 of the snap-action switch 44 so as to maintain the rod 46 under tensile stress and to urge the nut 64 against the end cap 56.

The housing 68 of the snap-action switch 44 is closed in use at its upper side by a cover plate 70 shown in FIGS. 1 and 2, but for clarity is shown open at its upper side in FIG. 3. Any movement of the rod 46 is transferred by way of the domed head 64 to a transfer member 72 which is slidably arranged in a bore formed in the housing 68, the bore being substantially coaxial with the rod 46. One end of the transfer member 72 bears against the domed head 64 and the other end bears against a contact spring 74 of the snap-action switch. Contact spring 74 is rigidly secured to a spring carrier 76 which is itself connected to a terminal 78 for conducting electric current. Spring carrier 76 is secured to the housing 68 by a rivet (not shown). Contact spring 74 carries a movable switch contact 80 and a snap-action spring 82 which bears against a part of the spring carrier 76 for providing snap-action of the spring 74 and movable contact 80. Also mounted in the housing 68 is a terminal 84 for carrying electric current and a fixed contact 86 connected to the terminal 84.

The tube portion 50 is made from a ceramic material which has the advantage that it has a naturally high electrical resistivity and thus avoids the need for a separate insulating member around the tube portion. Ceramic materials are also noted for their natural resistance to high temperatures and their long-term stability at such temperatures. Ceramic materials are readily available and can be formed by extrusion and moulding techniques which are relatively inexpensive when compared with the manufacture of a metal tube. The coefficient of thermal expansion of the ceramic material may be in the range from 7 to $12.5\times10^{-6}$ (39 to 78 per cent of the coefficient of thermal expansion of the rod) and preferably in the range from 8.3 to $10.5\times10^{-6}$ (46 to 66 per cent of the coefficient of thermal conductivity of the rod). Suitable ceramic materials are available under the Trade Marks STEATITE and FREQUENTITE, for example.

Although the coefficient of thermal expansion of the ceramic material is not as high as that of the rod, it is possible to adjust the effective expansion performance by regulating the emissivity of the ceramic material. Most ceramic materials naturally have a low emissivity; that is they reflect rather than absorb a major proportion of any incident radiation. By incorporating a material of high emissivity into the base ceramic material, or by coating the base ceramic material with a material of high emissivity, it is possible to raise the emissivity of the resulting ceramic material. This in turn results in absorption of a higher proportion of incident radiation and a higher operating temperature of the increased emissivity ceramic material as compared with the base ceramic material, at least during an initial heating phase. The higher operating temperature of the increased emissivity ceramic material offsets at least partly the effect of the lower coefficient of thermal expansion as compared with using a metal tube.

In use of the temperature control device according to the present invention as incorporated into a radiant electric heater as shown in FIGS. 1 and 2, when the central heating element 22 is energized the temperature within the wall 26 rises and the glass ceramic cooking surface 20 within the area defined by the wall 26 is also heated. Radiant energy also passes through the glass ceramic surface 20. The temperature sensor within the area defined by the wall 26 is influenced by the rising temperature and by the radiant energy and this causes the rod 46 to expand relative to the tube 52. Expansion of the rod 46 causes the domed head 64 to move towards the transfer member 72 and to urge the transfer member towards an actuating point of the contact spring 74. When the temperature sensor 42 detects a predetermined temperature of, say, 700° C. the contact spring 74 reaches its snap-over point and, assisted by the snap-action spring 82, moves the movable contact 80 to its open position thus de-energizing the heating element 22. As the temperature detected by the temperature sensor 42 falls, the rod 46 contracts and permits the contact spring 74 to move back towards its snap-over point. Once the temperature falls sufficiently, the contact spring 74 reaches its snap-over point and, assisted again by the snap-action spring 82, moves the movable contact 80 to its closed position as shown in FIG. 3 and energizes the heating element 22 once again. This cycle of on-off switching is repeated while the radiant electric heater is energized by a user of the glass ceramic top cooker.

When both heating elements 22 and 24 are energized the radiant electric cooker operates in a similar manner except that the temperature within the annular region between the walls 18 and 26 also rises. This causes the rod 46 in that region to expand and also the ceramic tube portion 50. However, since the coefficient of thermal expansion of the ceramic material is a significant proportion of the coefficient of thermal expansion of the rod material, the effect of the heating element 24 on the relative expansion of the rod 46 to the tube 52 is small and the contact spring 74 will reach its snap-over point when that part of the temperature sensor within the area defined by the wall 26 reaches substantially 700° C. and, assisted by the snap-action spring 82, will move the movable contact 80 to its open position thus de-energizing both heating elements 22 and 24. When the temperature within the area defined by the wall 26 falls sufficiently, the contact spring 74 will reach its snap-over point once more and, assisted by the snap-action spring 82, will move the movable contact 80 to its closed position as shown in FIG. 3 thus energizing both heating elements 22 and 24 once again.

Even without the effect of increasing the emissivity of the base ceramic material, we have found that a temperature control device according to the present invention performs quite adequately. By way of example, if a conventional temperature control device is used with a silica tube in place of the ceramic tube we have found that the temperature at which the rod operates the snap-action switch will decrease by about 95° C. when both heating elements are energized compared with when only the inner heating element is energized. When a temperature control device is used having a ceramic tube in the region of the outer heating element the temperature decrease is reduced to about 50° C.

We have found that if the temperature decrease between the two heating conditions is too small there is a risk of damaging the glass ceramic cooking surface under certain conditions, for example where both heating elements are energized, but the cooking utensil covers only the inner element. This can lead to overheating of the glass ceramic in the region of the outer heating element unless there is some response by the temperature sensor to the temperature in the region of the outer heating element.

The temperature control device and the radiant electric heater may be modified in a number of ways from the embodiment shown in the drawings. For example, the tube of ceramic material may be interchanged with the tube of fused silica, or more than one of at least one of the tubes may be provided. The radiant electric heater may be modified in numerous ways known to the skilled person and illustrated in the prior art. Merely by way of example, one or more of the heating elements may comprise an infrared lamp or more than two heating elements may be provided. Moreover, the heater need not be circular and may take any desired shape, such as rectangular or oval.

WE CLAIM

1. A device for controlling or limiting temperature in an electric cooking appliance, the device comprising switch means and a temperature sensor operatively coupled to the switch means, the temperature sensor comprising a rod arranged substantially coaxially within a tube, the rod being made of a material having a first coefficient of thermal expansion and the tube comprising at least two tube portions, one of the tube portions being made from a material having a second coefficient of thermal expansion lower than the first coefficient of thermal expansion and another of the tube portions being made from a ceramic material having a third coefficient of thermal expansion intermediate the first and second coefficients of thermal expansion.

2. A device according to claim 1, wherein the ceramic material comprises an electrically insulating material.

3. A device according to claim 1, wherein the third coefficient of thermal expansion is from 39 to 78 per cent of the first coefficient of thermal expansion.

4. A device according to claim 3, wherein the third coefficient of thermal expansion is from 46 to 66 per cent of the first coefficient of thermal expansion.

5. A device according to claim 1, wherein the tube comprises two tube portions.

6. A device according to claim 1, wherein the ceramic material has a relatively high emissivity.

7. A device according to claim 6, wherein the ceramic material incorporates a material having high emissivity.

8. A device according to claim 6, wherein the ceramic material is coated with a material having high emissivity.

9. A radiant electric heater for a cooking appliance comprising at least first and second heating elements defining separate heating areas for the cooking appliance, and a device for controlling or limiting temperature according to claim 1, the tube portions of the device being dimensioned and positioned such that each tube portion of material having the second coefficient of thermal expansion is exposed to heat emitted substantially from the first heating element and each tube portion of ceramic material having the third coefficient of thermal expansion is exposed to heat emitted substantially from the second heating element.

10. A radiant electric heater according to claim 9, wherein the heating elements are separated by at least one wall of thermal insulation material.

11. A radiant electric heater according to claim 10, wherein each junction between a tube portion of material having the second coefficient of thermal expansion and ceramic material having the third coefficient of thermal expansion is located within a separating wall.

* * * * *